US008610646B2

(12) United States Patent
Kohno et al.

(10) Patent No.: US 8,610,646 B2
(45) Date of Patent: Dec. 17, 2013

(54) ORGANIC ELECTROLUMINESCENCE DISPLAY DEVICE

(75) Inventors: Tohru Kohno, Kokubunji (JP); Hajime Akimoto, Kokubunji (JP); Naruhiko Kasai, Yokohama (JP); Masato Ishii, Tokyo (JP)

(73) Assignees: Japan Display Inc., Tokyo (JP); Panasonic Liquid Crysal Display Co., Ltd., Hyogo-ken (JP)

( * ) Notice: Subject to any disclaimer, the term of this patent is extended or adjusted under 35 U.S.C. 154(b) by 699 days.

(21) Appl. No.: 12/318,852

(22) Filed: Jan. 9, 2009

(65) Prior Publication Data

US 2009/0179832 A1 Jul. 16, 2009

(30) Foreign Application Priority Data

Jan. 11, 2008 (JP) ..... 2008-004530

(51) Int. Cl.
*G09G 3/30* (2006.01)

(52) U.S. Cl.
USPC ..... 345/77; 345/76

(58) Field of Classification Search
USPC ..... 345/76
See application file for complete search history.

(56) References Cited

U.S. PATENT DOCUMENTS 5,796,475 A * 8/1998 Kanzaki et al. ..... 356/239.4
6,050,717 A * 4/2000 Kosugi et al. ..... 700/17
2004/0207739 A1* 10/2004 Rossi ..... 348/300
2005/0110720 A1* 5/2005 Akimoto et al. ..... 345/76
2006/0139254 A1* 6/2006 Hayakawa et al. ..... 345/76
2006/0152468 A1* 7/2006 Ozaki ..... 345/102
2007/0217694 A1* 9/2007 Sullivan et al. ..... 382/232

FOREIGN PATENT DOCUMENTS

JP 63-109327 A 5/1988
JP 2002-229513 A 8/2002
JP 2005-156697 11/2003
JP 2004-205704 A 7/2004
JP 2006-048011 6/2005

* cited by examiner

*Primary Examiner* — Alexander Eisen
*Assistant Examiner* — Mark Regn
(74) *Attorney, Agent, or Firm* — Stites & Harbison PLLC; Jaun Carlos A. Marquez, Esq.; Nicholas B. Trenkle

(57) ABSTRACT

An organic electroluminescence display device is provided having a display section including a plurality of pixels arranged in a matrix; and a detection section for detecting a luminance characteristic of an OLED element in each of the pixels. The detection section includes a first path for allowing a detected characteristic value to pass therethrough and a second path for attenuating the detected characteristic value. A first switch is provided for the first path whereas a second switch is provided for the second path, the second switch being opened when the first switch is closed. The detected characteristic value having passed through any one of the first path and the second path is input to a same analog-to-digital converter to be converted into a digital quantity.

10 Claims, 15 Drawing Sheets

ORGANIC ELECTROLUMINESCENCE DISPLAY DEVICE

CLAIM OF PRIORITY

The present application claims priority from Japanese patent application JP 2008-004530 filed on Jan. 11, 2008, the content of which is hereby incorporated by reference into this application.

BACKGROUND OF THE INVENTION

1. Field of the Invention

The present invention relates to an organic electroluminescence (EL) display device, in particular, an organic EL display device including a system which enables both correction of a temperature characteristic and correction of screen burn-in.

2. Description of the Related Art

An organic electroluminescence display device (hereinafter, referred to as organic EL display device) has the following characteristics superior to those of a liquid crystal display device. For example, the organic EL display device is not required to include a backlight because the organic EL display device is self-emitting. The organic EL display device has excellent moving-image characteristics with a response time as small as several microseconds. Moreover, since a voltage required for light emission is as low as 10V or smaller for the organic EL display device, there is a possibility of reducing power consumption. Further, in comparison with a plasma display device and a field emission display (FED) device, the organic EL display device is more suitable for reduction in weight as well as in thickness because a vacuum structure is not required.

Each of organic light-emitting diode (hereinafter, referred to as OLED) elements constituting an organic EL display panel corresponding to a screen of the organic EL display device has a temperature characteristic. Even when the same voltage is applied to the OLED element, a current flowing through the OLED element is small at low temperature, whereas the current flowing therethrough is large at high temperature. Therefore, in order to obtain the same brightness, it is necessary to change a power supply voltage depending on the temperature of an external environment. Japanese Patent Application Laid-Open No. 2006-48011 (hereinafter, referred to as Patent Document 1) describes the following technology for detecting temperature fluctuation of the organic EL display panel. According to the technology, the result of detection of a voltage obtained by causing a current to flow from a current source through each of the OLED elements in the panel is subjected to A/D conversion. Then, a voltage of a voltage source for display is changed based on the obtained digital data.

Another problem inherent in the organic EL display device is so-called burn-in. The burn-in is a phenomenon that the OLED element has a lower luminance with elapse of an operation time. A change in characteristics of the OLED element appears as a change in voltage-current characteristic of the OLED element. Specifically, even when the same voltage is applied, the current flowing through the OLED element becomes smaller with elapse of the operation time. A change in characteristics of the OLED element with time differs for each pixel. Therefore, for accurate image display, it is necessary to detect the change in characteristics of the OLED element of each pixel and to feed back the result of detection to an input signal input from a host.

Japanese Patent Application Laid-Open No. 2005-156697 (hereinafter, referred to as Patent Document 2) describes the following technology for allowing the organic EL display panel to perform stable light emission without causing burn-in. According to this technology, the result obtained by measuring the current is subjected to A/D conversion. Based on the obtained digital data, feedback is performed on a driving signal of the OLED element.

With the technology described in Patent Document 1, it is possible to compensate for the effects of the temperature characteristic because the characteristics of the whole organic EL display panel are adjusted by changing the power supply voltage. However, local degradation such as the burn-in cannot be corrected by the technology of Patent Document 1. With the technology described in Patent Document 2, information of the temperature fluctuation generated in the panel cannot be digitally obtained by the AD conversion because the results obtained by the current measurement are compared between neighboring pixels.

A change in voltage of the OLED element is extremely small when the burn-in occurs on the organic EL display panel, whereas a change in voltage due to the temperature fluctuation is large. Therefore, if a voltage range of an analog-to-digital converter included in a system is to cover the temperature fluctuation, a large number of highly accurate comparators are required. As a result, a circuit size is increased to disadvantageously increase the power consumption.

SUMMARY OF THE INVENTION

The present invention has an object of realizing a system capable of simultaneously compensating for a temperature characteristic of an organic light-emitting diode (OLED) element and compensating for burn-in without increasing a circuit size and power consumption.

The present invention is to solve the problems described above, and relates to an organic electroluminescence (EL) display device including a system for converting a voltage fluctuation due to a temperature change to be compensated for and a voltage fluctuation due to burn-in to be corrected into the same voltage range and then for detecting the voltage fluctuation. Specifically, the organic EL display device includes a path for measuring a change in voltage due to a temperature characteristic and a path for measuring a change in voltage due to the burn-in. Furthermore, the number of pixels for which the burn-in is detected or a current value of a current source for detecting the burn-in is changed as feedback to a measured voltage which is detected as the temperature characteristic. As a result, the same voltage range is used for detecting the temperature characteristic and the burn-in characteristic. Specific means are as follows.

(1) An organic electroluminescence display device including: a display section including a plurality of pixels arranged in a matrix; and a detection section for detecting a luminance characteristic of an OLED element in each of the pixels, in which the detection section includes a first path for allowing the detected characteristic value to pass therethrough and a second path for attenuating a detected characteristic value, a first switch is provided for the first path whereas a second switch is provided for the second path, the second switch being opened when the first switch is closed, and the detected characteristic value having passed through any one of the first path and the second path is input to a same analog-to-digital converter to be converted into a digital quantity.

(2) An organic electroluminescence display device according to the item (1), in which a buffer amplifier is provided between the analog-to-digital converter and any one of the first path and the second path.

(3) An organic electroluminescence display device according to the item (1), in which the characteristic value is a voltage value at a terminal of the OLED element, the voltage value being generated by supplying a current from a current source provided in the detection section to the OLED element.

(4) An organic electroluminescence display device according to the item (1), in which the second path includes a first resistor, and the attenuation of the detected characteristic value is defined outside the second path by a ratio between a second resistor connected to the first resistor in series and the first resistor.

(5) An organic electroluminescence display device including: a display section including a plurality of pixels arranged in a matrix; and a detection section for detecting a temperature characteristic value of an OLED element in each of the pixels and a burn-in characteristic value of the OLED element, in which the detection section includes a first path for allowing the burn-in characteristic value to pass therethrough and a second path for attenuating the temperature characteristic value and allowing the attenuated temperature characteristic to pass therethrough, a first switch is provided for the first path whereas a second switch is provided for the second path, the second switch being opened when the first switch is closed, and the detected characteristic value having passed through any one of the first path and the second path is input to a same analog-to-digital converter to be converted into a digital quantity.

(6) An organic electroluminescence display device according to the item (5), in which a buffer amplifier is provided between the analog-to-digital converter and any one of the first path and the second path and.

(7) An organic electroluminescence display device according to the item (5), in which each of the temperature characteristic value and the burn-in characteristic value is a voltage value at a terminal of the OLED element, the voltage value being generated by supplying a current from a current source provided in the detection section to the OLED element.

(8) An organic electroluminescence display device according to the item (5), in which the temperature characteristic value is detected prior to the detection of the burn-in characteristic value, and a condition for the detection of the burn-in characteristic is determined by the temperature characteristic value digitalized by the analog-to-digital converter.

(9) An organic electroluminescence display device according to the item (8), in which the burn-in characteristic is measured for a plurality of the pixels in a row direction in the pixels arranged in the matrix.

(10) An organic electroluminescence display device according to the item (8), in which the burn-in characteristic is measured for a plurality of the pixels in a column direction in the pixels arranged in the matrix.

(11) An organic electroluminescence display device according to the item (5), in which each of the temperature characteristic value and the burn-in characteristic value is a voltage value at a terminal of the OLED element, the voltage value being generated by supplying a current from a constant current source provided in the detection section to the OLED element, and a current value supplied from the constant current source for detecting the burn-in characteristic differs from that supplied from the constant current source for detecting the temperature characteristic.

(12) An organic electroluminescence display device including: a display section including a plurality of pixels arranged in a matrix; and a detection section for detecting a temperature characteristic value of an OLED element in each of the pixels and a burn-in characteristic value of the OLED element, in which each of the temperature characteristic value and the burn-in characteristic value is a voltage value at a terminal of the OLED element, the voltage value being generated by supplying a current from a current source provided in the detection section to the OLED element, a detection switch for controlling a flow of the current from the current source to the OLED element is provided in the pixel, the detection switch being connected to the OLED element; the detection section includes a first path for allowing the burn-in characteristic value to pass therethrough and a second path for attenuating the temperature characteristic value and allowing the attenuated temperature characteristic to pass therethrough, a first switch is provided for the first path whereas a second switch is provided for the second path, the second switch being opened when the first switch is closed, and the detected characteristic value having passed through any one of the first path and the second path is input to a same analog-to-digital converter to be converted into a digital quantity.

According to the present invention, the detected value of the temperature characteristic and the detected value of the burn-in characteristic of the OLED element may be digitalized by the same analog-to-digital converter. Therefore, the size of a detection circuit may be prevented from being increased. Moreover, the circuit size and the power consumption of the analog-to-digital converter may be kept down.

According to the present invention, the organic EL display device providing a high-quality image which is obtained by compensating for both the temperature characteristic and the burn-in characteristic of the OLED element may be realized. Moreover, since the circuit size for detecting the temperature characteristic and the burn-in characteristic of the OLED element may be prevented from being increased, the fabrication cost and the power consumption of the organic EL display device may be kept down.

BRIEF DESCRIPTION OF THE DRAWINGS

In the accompanying drawings:

FIG. 11 is a graph showing a degradation characteristic of the OLED element due to burn-in;

FIG. 12 is a schematic diagram illustrating screen burn-in;

DETAILED DESCRIPTION OF THE INVENTION

Figure 11:
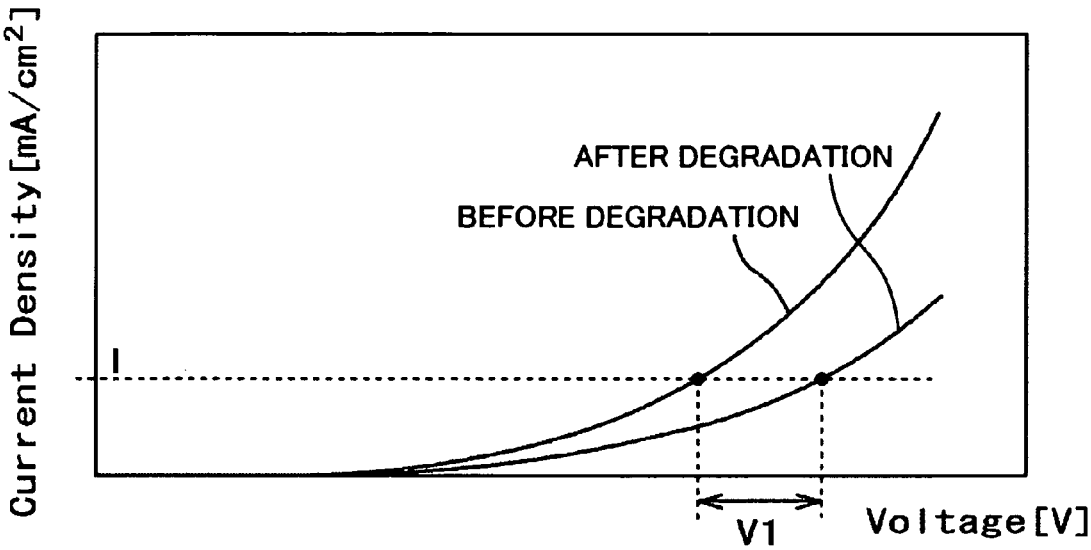

Prior to the description of specific embodiments of the present invention, a burn-in characteristic and a temperature characteristic of an organic electroluminescence display (hereinafter, referred to as organic EL display) panel are described. FIG. 11 is a graph showing a state where a characteristic of each individual organic light-emitting diode (hereinafter, referred to as OLED) element varies with an operation time. In FIG. 11, an abscissa axis represents a voltage applied to the OLED element, whereas an ordinate axis represents a current flowing through the OLED element. In FIG. 11, a curve "before degradation" represents a characteristic of the OLED element in an initial state, whereas a curve "after degradation" represents the characteristic of the OLED element after the OLED element is operated for a specific period of time. In comparison between the characteristic before degradation and that after degradation, it is understood that it is necessary to apply a voltage larger than that applied before degradation by V1 to cause the same current I to flow through the OLED element after degradation. Conversely, if the same voltage is applied to the OLED element before and after degradation, a luminance is lowered after degradation.

Figure 12:
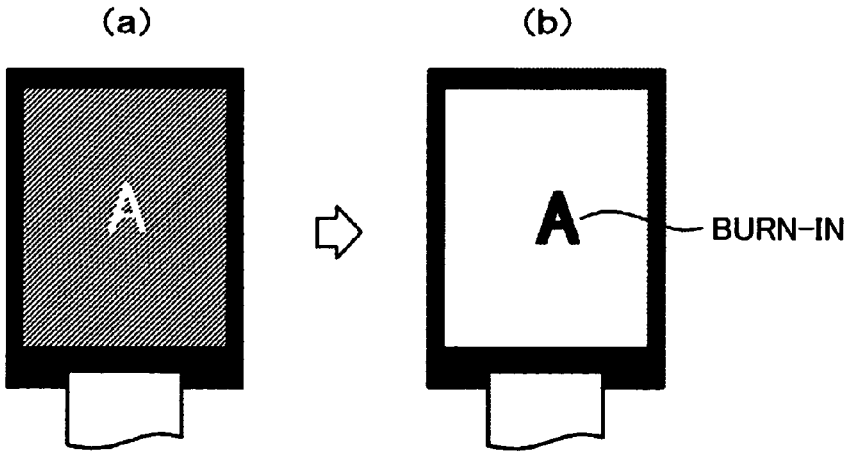

When the degradation of the characteristic of the OLED element as described above occurs in the same fashion for the OLED elements over the entire screen, the effects caused by the degradation are relatively small. In reality, however, a bright area and a dark area are generated on the screen for some images. Since a larger current flows through each of the OLED elements in the bright area, the degradation is accelerated in the bright area. FIG. 12 shows a state of the degradation.

Part (A) in FIG. 12 shows a state where a letter "A" is displayed on the dark screen. On the screen in this state, a larger current flows through the OLED elements in an area corresponding to the letter "A". Part (B) in FIG. 12 shows a state where, for example, a white image is displayed on the entire screen after elapse of a predetermined period of time in the state illustrated in the part (A). Though the white image should be displayed on the entire screen as a correct image in the part (B), the luminance of the area corresponding to the letter "A" is lowered because the OLED elements in the area corresponding to the letter "A" are degraded by the display in the state illustrated in the part (A). This phenomenon is called burn-in. In order to correct the burn-in, it is necessary to increase the voltage applied to the corresponding OLED elements. For increasing the voltage, it is necessary to detect the position of the OLED element degraded by the burn-in and the amount of degradation and then to feed back the detected position and amount of degradation.

Figure 13:
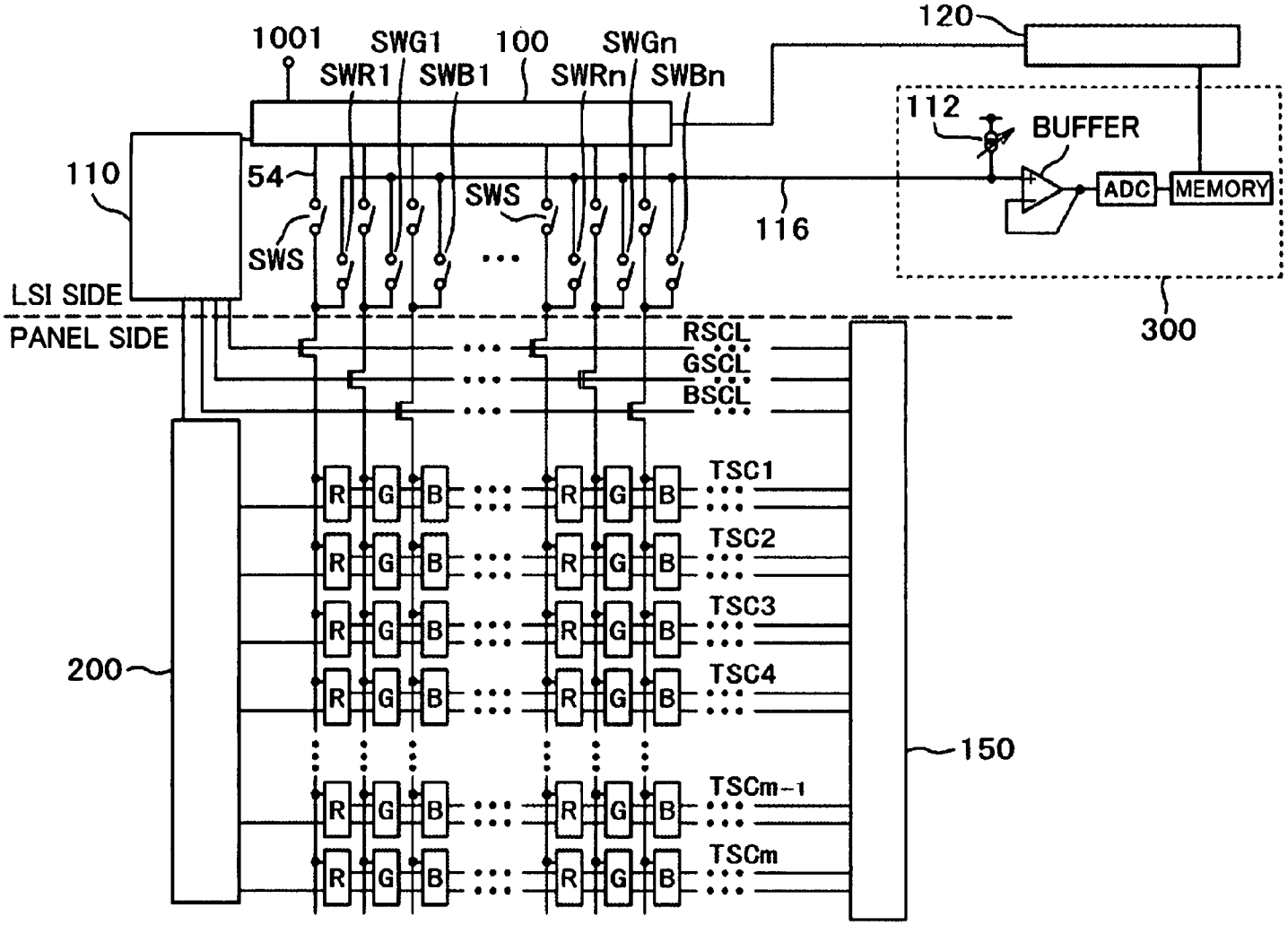
FIG. 13 is a view illustrating a detection circuit of the OLED element without application of the present invention.

FIG. 13 illustrates a circuit for measuring a voltage-current characteristic of each of the OLED elements to detect the burn-in. In the middle of FIG. 13, a display section including a large number of the OLED elements which are denoted by R, G, and B is formed. As illustrated in FIG. 13, the OLED elements include a red light-emitting OLED element R, a green light-emitting OLED element G, and a blue light-emitting OLED element B. On the left of the display section, a scanning circuit for display 200 which generates a scanning signal for display is provided. On the right of the display section, a scanning circuit for detection 150 for detecting the characteristics of each of the OLED elements is provided. Above the display section illustrated in FIG. 13, a signal driving circuit 100 for supplying an image signal to each of the OLED elements is provided. The image signal is input to the signal driving circuit 100 through a signal input line 1001 from the exterior.

In the upper left part of FIG. 13, a timing controller 110 for controlling pulse signals from the scanning circuit for display 200, the scanning circuit for detection 150, the signal driving circuit 100 and the like is provided. In the upper right part of FIG. 13, a detection section 300 for measuring and recording the characteristics of the OLED element is provided. Between the signal driving circuit 100 and the display section, signal line switches SWS, detection line switches SWR, SWG and SWB, an R-control line RSCL, a G-control line GSCL and a B-control line BSCL are provided. Each of the signal line switches SWS feeds the image signal to the OLED element. The detection line switches SWR, SWG and SWB serve to detect the characteristics of the OLED element. Each of the R-control line RSCL, the G-control line GSCL and the B-control line BSCL determines the color of the OLED elements to be measured.

In FIG. 13, for displaying an image, the signal line switches SWS are closed whereas the detection line switches SWR1 to SWRn, SWG1 to SWGn, and SWB1 to SWBn are opened. The OLED elements are scanned by the scanning circuit for display 200 in this state to display the image on the display section according to the image signals.

In FIG. 13, when the image is displayed for one frame, the signal line switches SWS are opened whereas the detection line switches SWR1 to SWRn are closed to start the detection. For the detection of the OLED elements present in a first row by the scanning circuit for detection 150, a first detection switch control line TSC1 is turned ON, whereas the other detection switch control lines are OFF. The detection is performed for each color. Therefore, when the R-detection line switches SWR1 to SWRn are closed, the R-control line RSCL becomes ON. When the OLED elements in a specific row are selected by the scanning circuit for detection 150, the detection line switches SWR1 to SWRn are sequentially opened and closed to measure the voltage-current characteristic of each of the OLED elements.

The characteristics of the OLED element are measured by causing a current from a constant current source 112 of the detection section 300 to flow through each of the OLED elements to measure a terminal voltage of each of the OLED elements. The terminal voltage of each of the OLED elements is amplified by a buffer amplifier, and is then input to an analog-to-digital converter ADC. An output from the analog-to-digital converter ADC is accumulated in a memory to be used as feedback data. A correction control section 120 gives feedback of the respective characteristics of the OLED elements accumulated in the memory to the signal driving circuit 100 to acquire the image signal obtained by compensating for the degradation of each of the OLED elements due to burn-in.

When the measurement of the red light-emitting OLED elements in the first row is terminated in the above-mentioned manner, the green light-emitting OLED elements in the first row are measured. Thereafter, the blue light-emitting OLED elements in the first row are measured. When the measurement of the characteristics of the OLED elements for one row is terminated, a second detection switch control line TSC2 becomes ON to start the measurement of the OLED elements in a second row. Thereafter, the measurement is continued in the same manner until an m-th detection switch control line TSCm.

Figure 14:
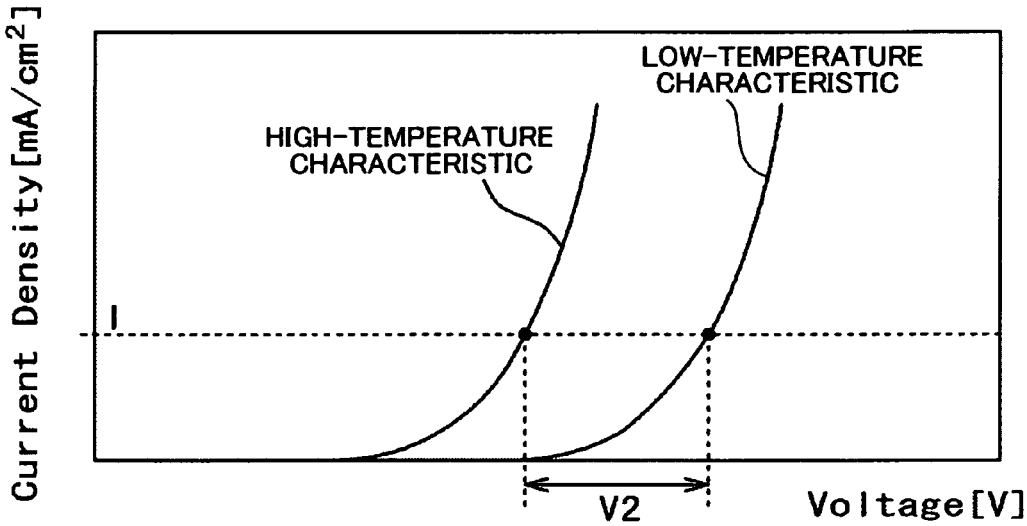
FIG. 14 is a graph showing the temperature characteristic of the OLED element.

FIG. 14 is a graph showing the effects of the temperature characteristic of the OLED element. In FIG. 14, an abscissa axis represents the voltage applied to the OLED element, whereas an ordinate axis represents the current flowing through the OLED element. In FIG. 14, a high-temperature characteristic corresponds to the voltage-current characteristic when the OLED element is at a high temperature, whereas a low-temperature characteristic corresponds to the voltage-current characteristic when the OLED element is at a low temperature. As illustrated in FIG. 14, for causing the same current I to flow through the OLED element, the voltage, which is larger than the voltage required at the high temperature by V2, is required to be applied at the low temperature. In other words, if the same voltage is applied to the OLED element, the current is lowered at the low temperature to reduce the luminance.

Figure 15:
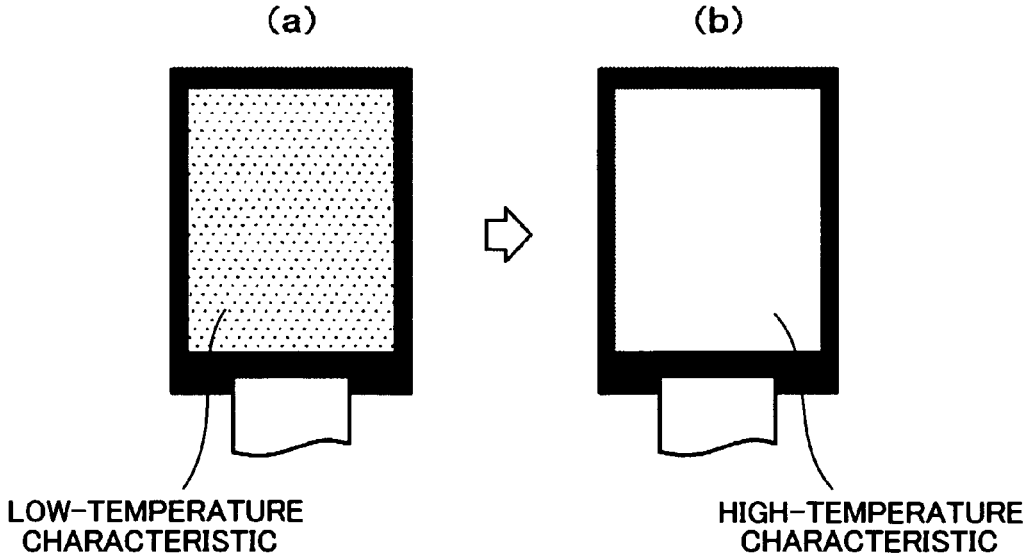
FIG. 15 is a schematic diagram illustrating a change in brightness of the screen depending on the temperature.

FIG. 15 illustrates the state as described above and show the case where the same voltage is applied to the OLED elements for white display. Part (A) in FIG. 15 shows the screen at the low temperature, whereas Part (B) in FIG. 15 shows the screen at the high temperature. Even when the image signals for the same white display are fed, the luminance is higher at the high temperature. With such a high luminance, the image cannot be precisely reproduced. Therefore, it is necessary to detect the temperature of each of the OLED elements to give feedback of the temperature characteristics of the OLED elements to the power supply.

Figure 16:
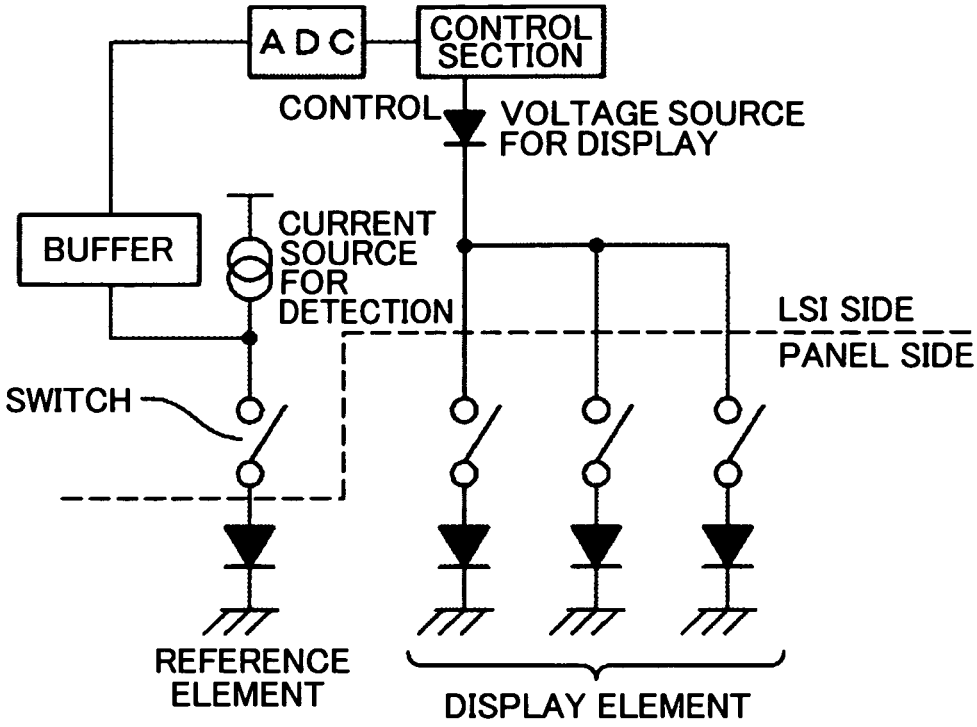
FIG. 16 is a view illustrating an example of a circuit for detecting the temperature characteristic of the OLED element.

FIG. 16 illustrates a circuit for detecting the temperature characteristic of each of the OLED elements and feeding back the detected temperature characteristic to the power supply to compensate for a change in luminance due to the temperature characteristic. In FIG. 16, a reference element for temperature measurement is provided. A constant current is made to flow from a current source for detection through the reference element to measure a terminal voltage of the reference element. As a result, a temperature of the OLED element is obtained. The obtained terminal voltage is amplified by the buffer amplifier, and is then input to the analog-to-digital converter ADC to be subjected to AD conversion. A voltage of a voltage source for display is changed based on the digital data obtained by the conversion. As a result, the luminance may be kept constant.

An object of the present invention is to realize a system having both of the functions of burn-in detection and temperature detection described above. A problem in the realization of such a system is a great difference between a fluctuation amount V1 in voltage due to the burn-in and a fluctuation amount V2 in voltage due to the temperature change illustrated in FIG. 11. More specifically, the fluctuation amount V1 is about several mV to a dozen mV, whereas the fluctuation amount V2 varies within the range of several V when the temperature changes from −20° C. to 80° C.

In this case, if the circuit illustrated in FIG. 13 is used for the system, there arises the need of preparing the analog-to-digital converter ADC having accuracy high enough to measure the variation V1 and an operation range covering the fluctuation amount V2. In this case, since the number of the comparators included in the analog-to-digital converter is as large as several tens to several hundreds, the detection section becomes extremely large and the power consumption is correspondingly increased. On the other hand, since the system illustrated in FIG. 16 is not capable of detecting the characteristics of each of the OLED elements in the panel, the system for detecting both the temperature characteristic and the burn-in characteristic cannot be constructed.

According to the present invention described below, the system having both the functions of the burn-in detection and the temperature detection described above may be realized. The detailed contents of the present invention are disclosed with the description of exemplary embodiments below.

FIRST EMBODIMENT

Figure 1:
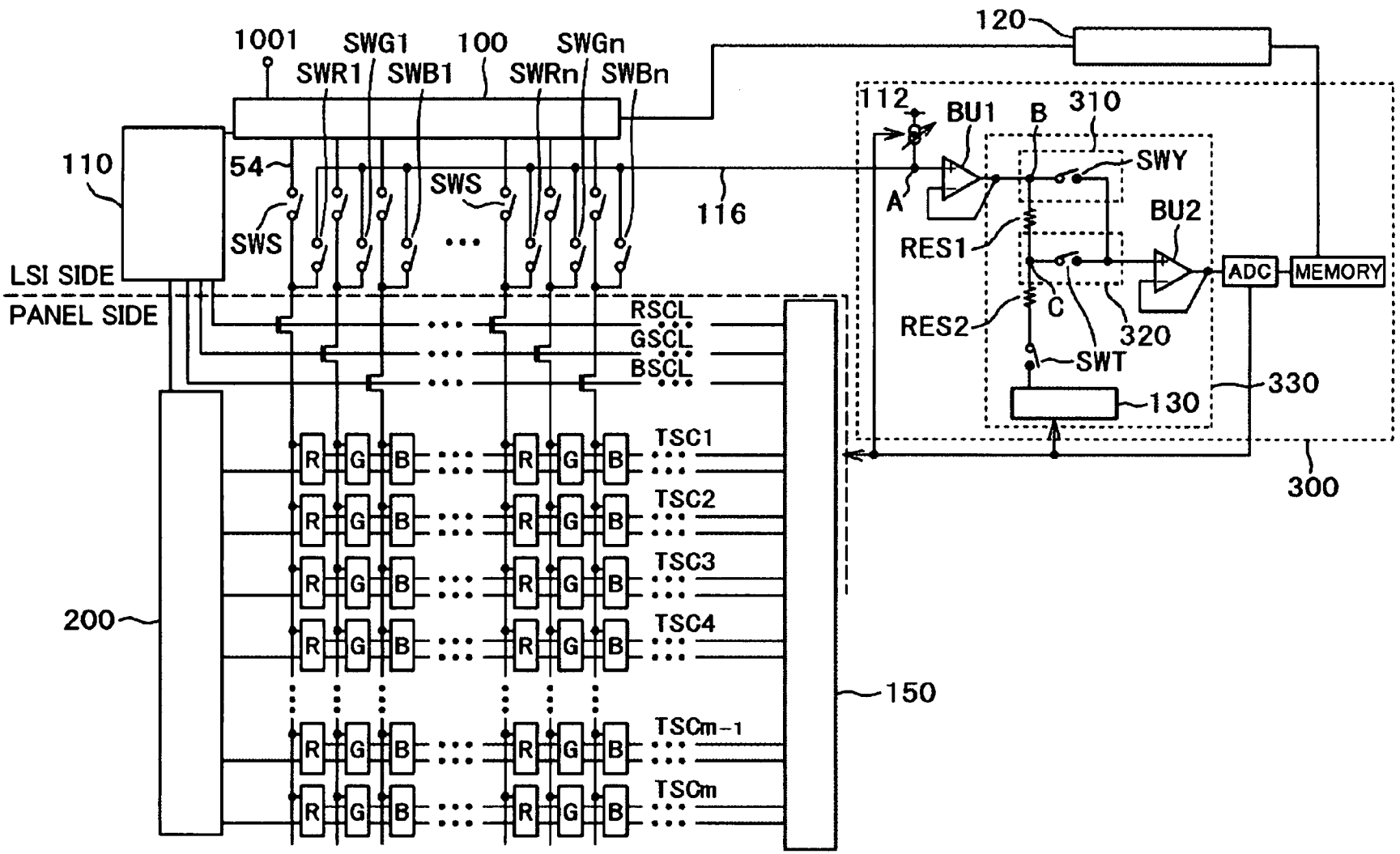
FIG. 1 is a circuit configuration diagram of an organic EL display device according to a first embodiment.

FIG. 1 illustrates a configuration of an organic EL display device according to the present invention. In the middle of FIG. 1, a large number of the OLED elements denoted by R, G and B are arranged in a matrix to form the display section. The scanning circuit for display 200 provided on the left of the display section, the scanning circuit for detection 150 provided on the right of the display section, the signal driving circuit 100 provided above the display section and the like are the same as those described referring to FIG. 13. The timing controller 110 for controlling the timing of the signals provided in the upper left part of FIG. 1 is also the same as that described referring to FIG. 13. Furthermore, the signal line switches SWS, the detection line switches SWR, SWG and SWB, the R-control line RSCL, the G-control line GSCL, and the B-control line BSCL, which are provided between the display section and the signal driving circuit 100, are the same as those illustrated in FIG. 13.

The present invention is characterized by a detection section 300 for measuring the temperature characteristic and the burn-in characteristic of the OLED element. The temperature and the burn-in are both detected by measuring the voltage-current characteristic of the OLED element. The voltage-current characteristic is measured by supplying the current from the constant current source 112 to each of the OLED elements and then measuring the terminal voltage of the OLED element. In FIG. 1, the terminal voltage of the OLED element is input to a first buffer amplifier BU1. Then, the terminal voltage is output from the first buffer amplifier BU1 to a point B. A change in terminal voltage due to the burn-in, specifically, a change in voltage at a point A is in the range of several mV to several dozen mV. On the other hand, a change in terminal voltage due to a temperature change, specifically, a change in voltage at the point A varies by several V when the temperature changes from −20° C. to 80° C.

In order to cope with the above-mentioned problem, the detection section 300 is provided with a path selection section 330 in the present invention. In FIG. 1, for detection of the temperature characteristic of the OLED element, a switch SWT is closed whereas a switch SWY remains opened. When the temperature characteristic of the OLED element is detected, a change in voltage generated at the point A reaches several V, which is several orders of magnitude larger than that when the burn-in is detected. Therefore, a fluctuation generated at the point B is remarkably larger than that generated when the burn-in is detected. If the output in the case of the burn-in detection and the output in the case of the temperature detection are attempted to be directly converted by the analog-to-digital converter ADC into the digital data, the circuit size is remarkably increased and the power consumption is also increased.

In the present invention, for the temperature detection, the output from the first buffer amplifier BU1, that is, the voltage at the point B is not directly supplied to a second buffer amplifier BU2. Instead, after being lowered by resistive division, the voltage at the point B is supplied to the second buffer amplifier BU2. This path is referred to as a second path 320. In this manner, the range of voltage to be input to the analog-to-digital converter ADC is limited to reduce the size of the analog-to-digital converter ADC. As a result, the power consumption can also be prevented from increasing. A potential at a point C with respect to that at the point B illustrated in FIG. 1 may be determined by a ratio between a first resistor RES1 and a second resistor RES2. The ratio between the first resistor RES1 and the second resistor RES2 is selected to allow the voltage fluctuation at the point C to be about several tens of mV when the voltage fluctuation at the point B is several V. In many cases, the ratio between the first resistor RES1 and the second resistor RES2 is selected to allow the potential at the point C to be one-tenth or less of the potential at the point B.

The potential at the point C, which is obtained as a result of the temperature detection, is input to the second buffer amplifier BU2 through the switch SWT, and is then converted into the digital data by the analog-to-digital converter ADC. Based on the obtained digital data, the feedback is performed for the control of the current source 112 or the scanning circuit for detection 150 or for the selection of the number of the OLED elements to be subjected to the burn-in detection at one time. The detection voltage of the OLED element in the burn-in detection is also adjusted based on the obtained digital data. A bias circuit 130 adjusts the potential at the point C based on the data obtained by the analog-to-digital converter ADC to allow the potential to fall within an input range of the analog-to-digital converter ADC. As a result, the temperature detection and the burn-in detection may be performed in the same system without increasing the circuit size of the analog-to-digital converter ADC.

For the detection of the burn-in characteristic of the OLED element, the switch SWY is closed whereas the switch SWT remains opened. Therefore, in this case, the burn-in characteristic is measured through a first path 310. For the measurement of the burn-in characteristic of the OLED element, the potential at the point B is directly input to the second buffer amplifier BU2 through the switch SWY. Then, after being amplified by the second buffer amplifier BU2, the potential at the point B is input to the analog-to-digital converter ADC to be converted into the digital data and is then recorded in a memory. The burn-in characteristic is measured by the comparison between the voltage-current characteristics of the neighboring pixels. Specifically, since the same current flows through the OLED elements, it is judged that the burn-in occurs for the OLED element having the higher terminal voltage. Then, the voltage of the image signal to be fed to the OLED element, for which the burn-in occurs, is set correspondingly high.

Figure 2:
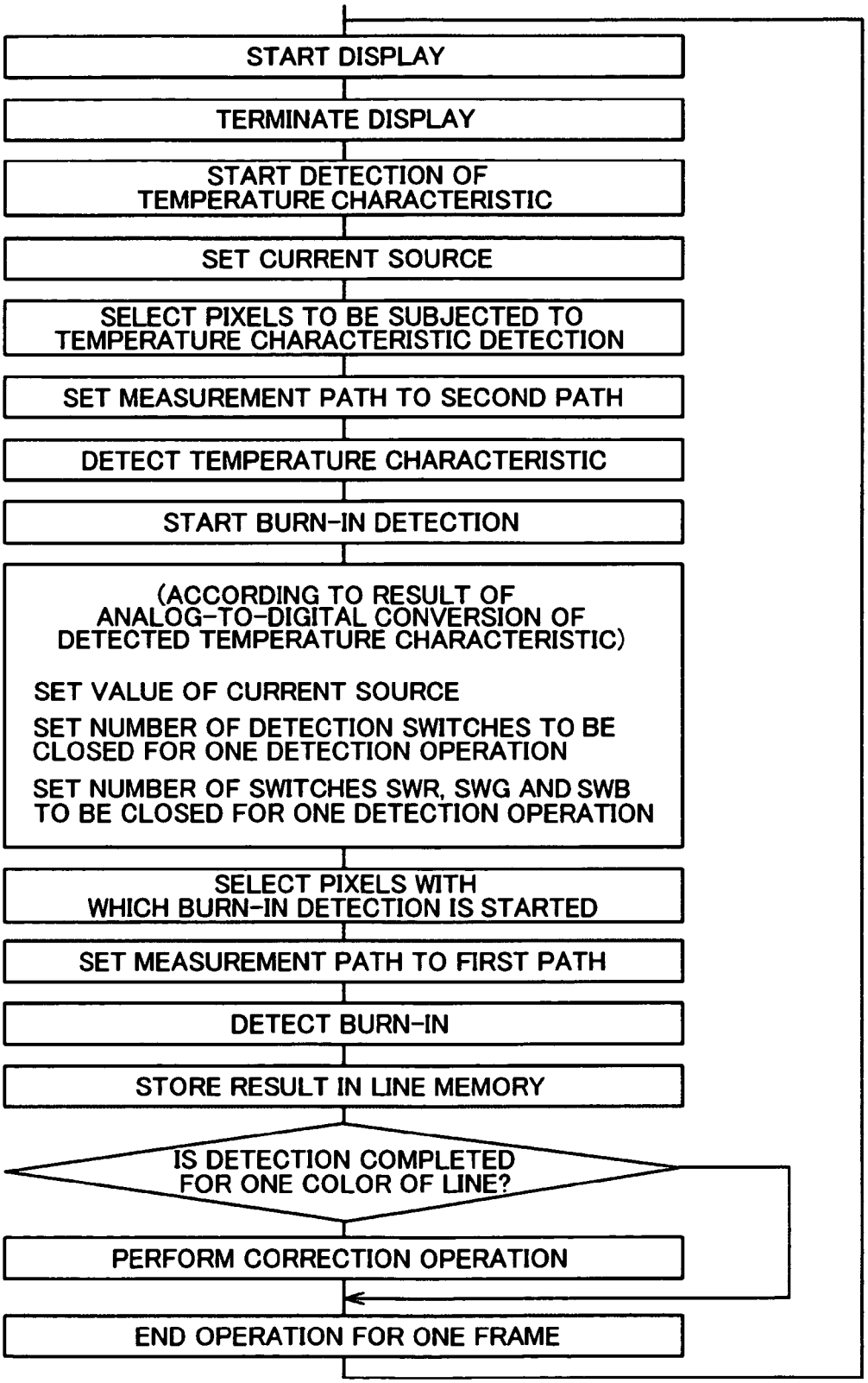
FIG. 2 is a flowchart of detection of a temperature characteristic and a burn-in characteristic of an OLED element.

FIG. 2 is a flowchart of display, the temperature detection and the burn-in detection of the organic EL display device in the present invention. In FIG. 2, "start display" means display for one frame is started, and "terminate display" means the display for one frame is terminated. After the termination of the display, the temperature characteristic is detected. First, the current source 112 is set. Specifically, the magnitude of the current to be supplied from the constant current source 112 is set. Then, the pixels to be subjected to the temperature detection are selected. As the pixels to be subjected to the temperature measurement, arbitrary pixels may be selected.

The measurement path of the detection section 300 is set to the second path 320 to detect the temperature characteristics of the selected OLED elements. Thereafter, the burn-in detection is started. Before the burn-in detection is actually started, the setting of a value of the current source 112, the number of the OLED elements in a row direction to be subjected to the burn-in detection at one time, or the number of the OLED elements in a column direction to be subjected to the burn-in detection at one time is determined based on the data of the detected temperature obtained by the conversion by the analog-to-digital converted ADC. For the measurement of the burn-in characteristic, the OLED elements may be measured one by one. Alternatively, a plurality of the OLED elements may be measured at one time in view of a measurement time. When the plurality of the OLED elements is measured at one time, however, the number of the OLED elements which may be measured at one time is limited because the voltage-current characteristics at the respective terminals of the OLED elements differ in comparison with the case where the OLED elements are measured in a one-by-one manner.

The pixels, with which the burn-in detection is started, are selected to start an operation of the burn-in detection. In general, the detection of the burn-in characteristic is started with the OLED elements of which the temperature characteristics have already been detected. In this case, the measurement path in the detection section 300 illustrated in FIG. 1 is set to the first path 310. The burn-in is detected for each of the OLED elements, and the result of detection is stored in the memory. The detection is performed for each line and for each color. When the measurement is completed for one line, a correction operation is performed. Specifically, the voltage of the image signal to be fed to the OLED element having the degraded voltage-current characteristic due to the burn-in is corrected to be higher to compensate for the degradation.

If the operation of the burn-in detection is not completed for one line within a predetermined period of time, the subsequent operation of the burn-in detection is performed in a next frame. At the completion of the detection for one line in the next frame, the correction for the burn-in is performed. As described above, the burn-in detection and the correction for the burn-in are performed for all the OLED elements over a plurality of frames. The temperature detection and the burn-in detection are repeated each time the organic EL display device operates.

Figure 3:
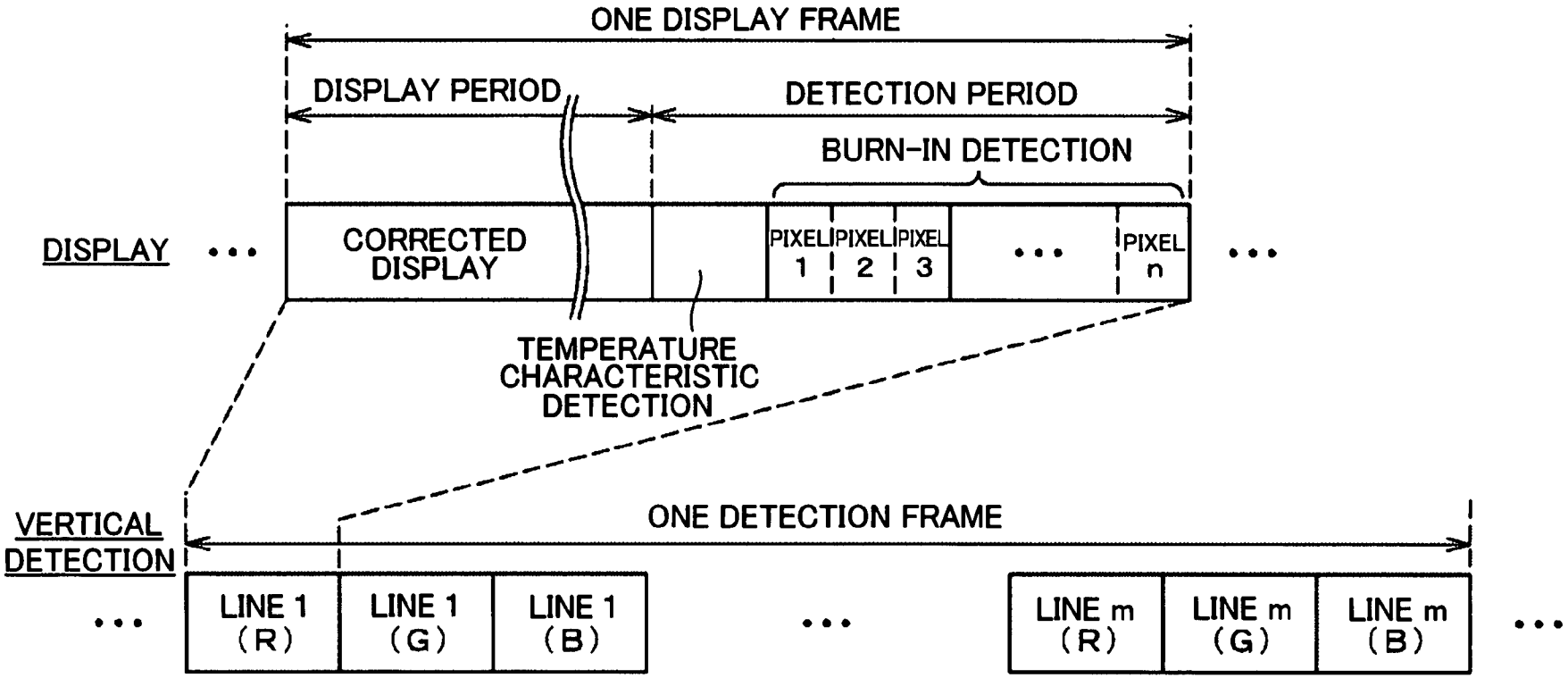
FIG. 3 is a view of time assignment in one frame according to the first embodiment.

FIG. 3 illustrates an example of time assignment in one frame. FIG. 3 illustrates the case where all the pixels in a horizontal direction are detected in one frame. In FIG. 3, upon end of a display period, a detection period starts. The detection period is shorter than the display period. In the detection period, the temperature characteristic is first detected. Then, after condition for the burn-in detection is determined, the sequential measurement is started with a first line. In FIG. 3, all red pixels are first measured on the first line. Then, after all green pixels are measured, all blue pixels are measured. When the measurement of all the pixels on the first line is completed, the pixels on a second line are measured. The measurement is repeated until the last m-th line. FIG. 3 illustrates the case where the measurement of all the pixels of the same color on one line is completed in one frame.

Figure 4:
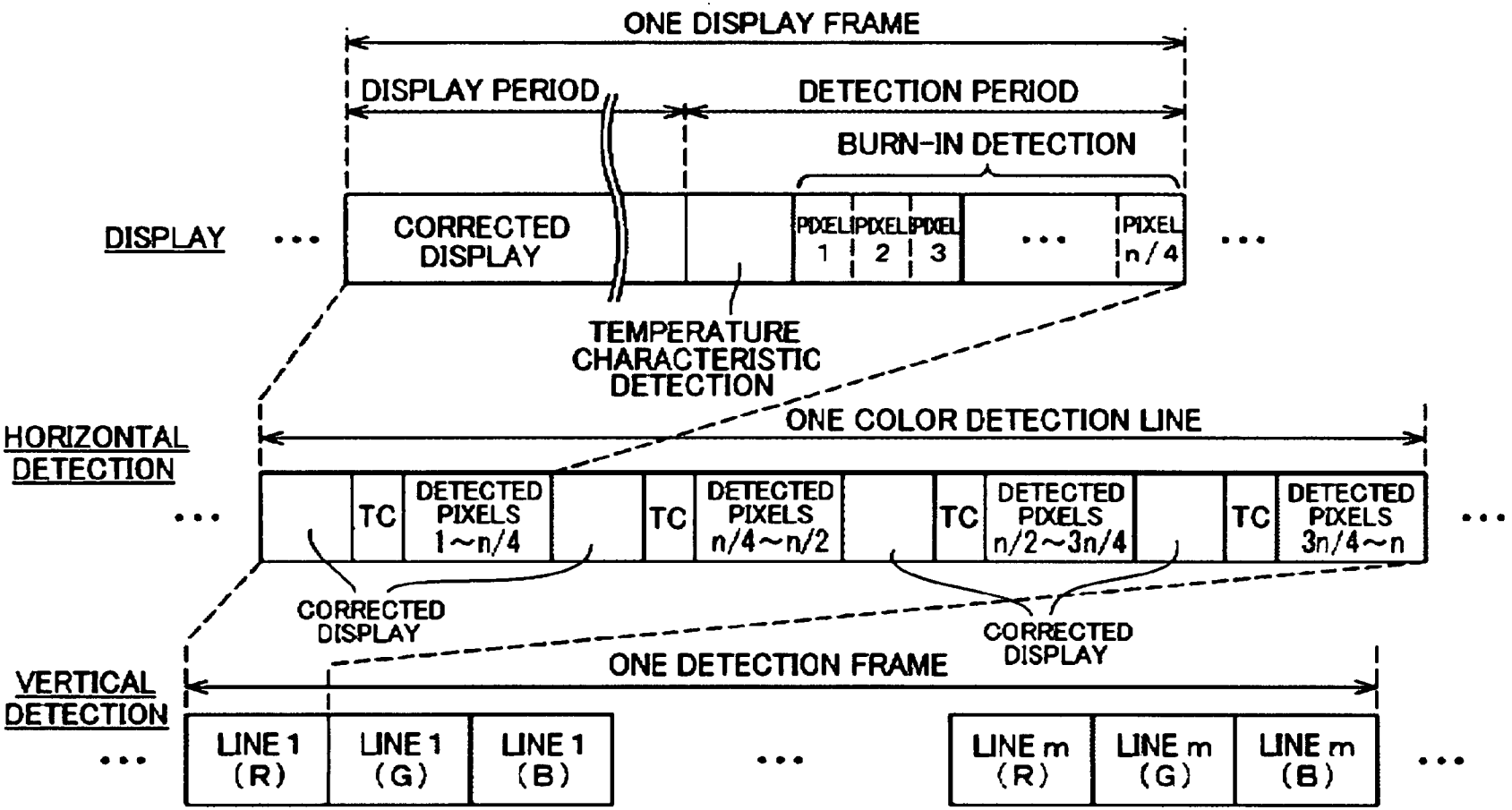
FIG. 4 is another view of the time assignment in one frame according to the first embodiment.

FIG. 4 illustrates another example showing the time assignment in one frame. FIG. 4 illustrates the case where the detection of all the pixels on one line cannot be completed in one frame and therefore only one-fourth of the pixels of the same color on one line are detected in one frame. Specifically, though n pixels are arranged for each of the colors R, G and B, the burn-in characteristic is detected for only n/4 pixels in one frame. In FIG. 4, "TC" means the period of the temperature detection which is also described as "temperature characteristic detection".

In this case, the detection of the temperature characteristic always precedes the detection of the burn-in characteristic in each frame. The last pixel measured in the previous frame and the first pixel to be measured in the next frame are the same pixel. As a result, for the comparison between the neighboring pixels, a problem of an environmental change such as an ambient temperature change may be eliminated.

Figure 5:
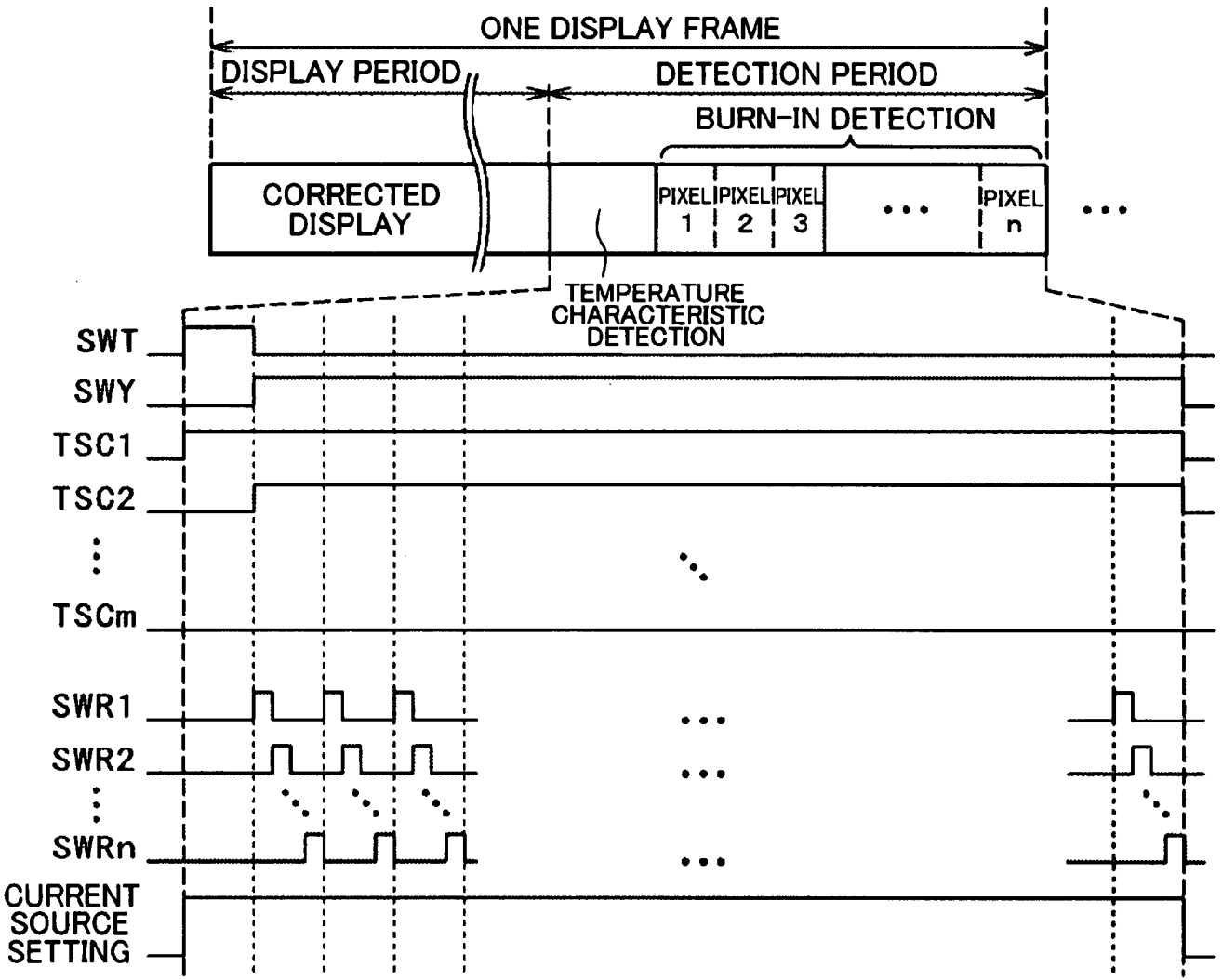
FIG. 5 is a time chart of the first embodiment.

FIG. 5 is an example of a time chart of the organic EL display device in this first embodiment. In the example illustrated in FIG. 5, after the temperature characteristic is detected to calculate the condition, a plurality of the detection switch control lines TSC extending from the scanning circuit for detection 150 are turned ON to adjust the detection voltage of the OLED element. As described above, by simultaneously measuring a plurality of the OLED elements, the voltage-current characteristic at the terminal of the OLED element may be changed. Specifically, the voltage fluctuation value to be input to the analog-to-digital converter ADC may be varied depending on the number of the OLED elements to be measured at one time. More specifically, when the temperature is low and the resistance of the OLED element is high, a larger number of the OLED elements are detected at one time. As a result, the input voltage to the analog-to-digital converter ADC may be set within a predetermined range.

The reference numerals shown in FIG. 5 correspond to those of FIG. 1. In FIG. 5, the switch SWT is first closed and the switch SWY is opened to measure the temperature characteristic of the OLED element. Specifically, in the detection section 300 illustrated in FIG. 1, the second path 320 is selected. Since the pixels whose temperature characteristics are to be measured are present in the first line at this time, the first detection switch control line TSC1 is in an ON state. Thereafter, the switch SWT is turned OFF and the switch SWY is turned ON to select the first path 310 illustrated in FIG. 1 to start the detection of the burn-in characteristic.

In FIG. 5, at the time of start of the burn-in characteristic, the first detection switch control line TSC1 and the second detection switch control line TSC2 are ON. In this case, a third detection switch control line TSC3 and subsequent detection switch control lines are OFF. When, for example, the switch SWR1 is turned ON in this state, the red light-emitting OLED elements on the first detection switch control line TSC1 and the second detection switch control line TSC2 are detected. Then, when the detection is completed for a switch SWRn, the burn-in characteristics of all the red light-emitting OLED elements controlled by the first detection switch control line TSC1 or the second detection switch control line TSC2 are detected. In this first embodiment, the value of the current source 112 remains as initially set.

Then, when the detection and measurement of the burn-in characteristics of all the OLED elements on the first detection switch control line TSC1 and the second detection switch control line TSC2 are completed, a third detection switch control line TSC3 and a fourth detection switch control line TSC4 are selected by the scanning circuit for detection 150 to start the detection of the burn-in characteristics of the OLED elements on the third detection switch control line TSC3 and the fourth detection switch control line TSC4. In this manner, the burn-in characteristics of the OLED elements are detected for each set of two detection switch control lines to complete the detection of the burn-in characteristics of all the OLED elements.

Though the burn-in characteristics of the OLED elements on the first detection switch control line TSC1 and the second detection switch control line TSC2 are simultaneously measured for the detection of the burn-in characteristic in the above description, the OLED elements on the first detection switch control line TSC1, the second detection switch control line TSC2, and the third detection switch control line TSC3 or a larger number of the detection switch control lines may be simultaneously detected. Moreover, though the burn-in characteristics of the plurality of the OLED elements are detected at one time in this embodiment, it is apparent that the burn-in characteristic of only one OLED element may be detected depending on the condition.

SECOND EMBODIMENT

Figure 6:
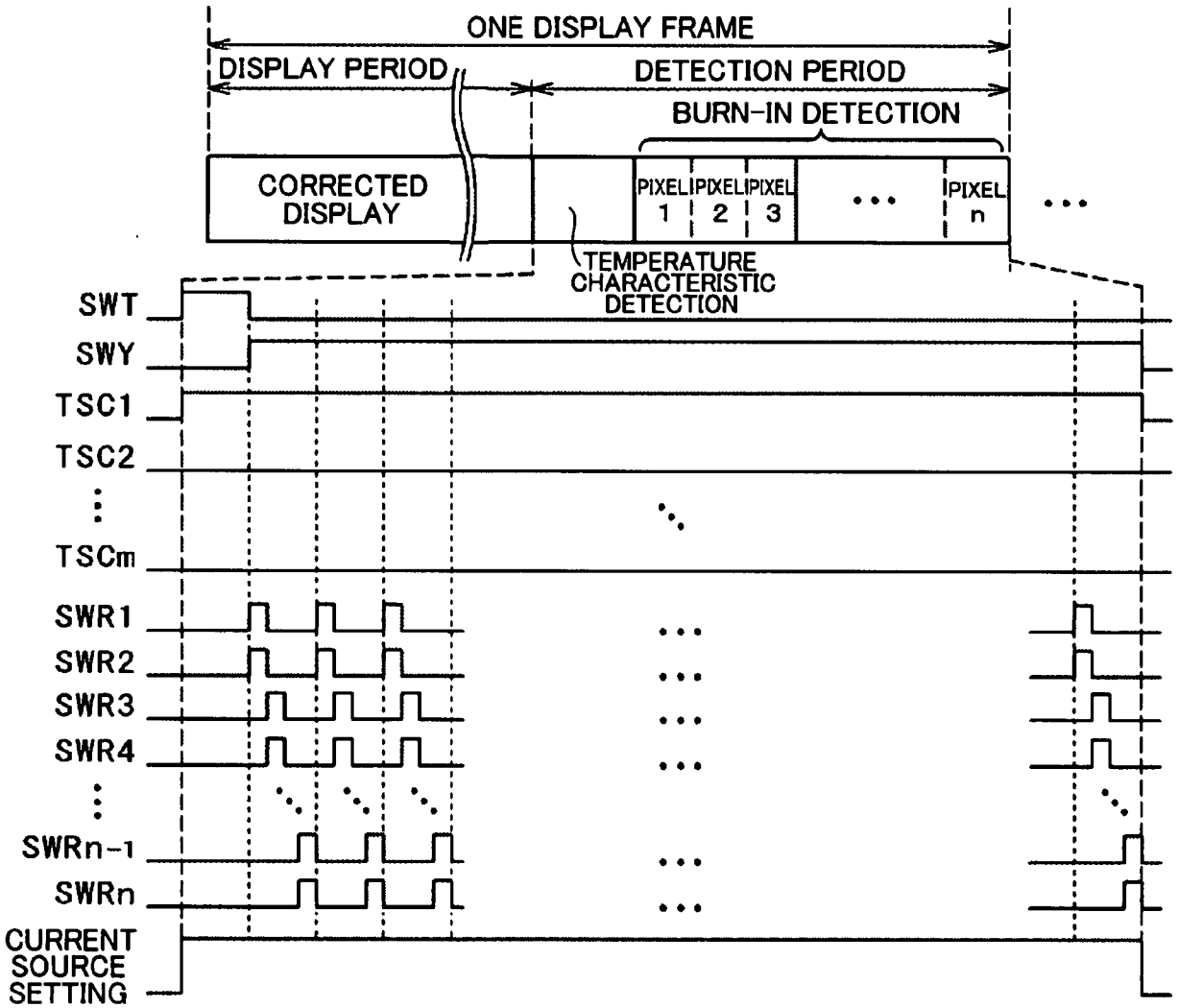
FIG. 6 is a time chart of a second embodiment.

Though a second embodiment is the same as the first embodiment in the configuration of the organic EL display device, the second embodiment differs from the first embodiment in the method of detecting the burn-in. FIG. 6 is a time chart of the burn-in detection in this embodiment. In FIG. 6, as in the first embodiment, the temperature detection is first performed after the termination of the display. In this embodiment, after the temperature detection, it is determined that the burn-in characteristics of two OLED elements are simultaneously detected. In this case, however, in contrast to the first embodiment, the burn-in characteristics of two OLED elements on the same detection switch control line TSC are detected.

In FIG. 6, after the temperature detection, only the first detection switch control line TSC1 is in the ON state. In this state, the switches SWR1 and SWR2 first simultaneously become ON. Therefore, the burn-in characteristics of first and second red light-emitting OLED elements are detected. Thereafter, the switches SWR3 and SWR4 become ON to detect the burn-in characteristics of third and fourth red light-emitting OLED elements. In this manner, the burn-in characteristics of each set of two red light-emitting OLED elements on the first detection switch control line TSC1 are sequentially detected. After the completion of the measurement of the burn-in characteristics of all the red light-emitting OLED elements on the first detection switch control line TSC1, the burn-in characteristics of the green light-emitting OLED elements and then those of the blue light-emitting OLED elements on the first detection switch control line TSC1 are measured. Then, after the completion of the measurement of the burn-in characteristic of all the OLED elements on the first detection switch control line TSC1, the temperature characteristics and the burn-in characteristics of the OLED elements on the second detection switch control line TSC2 are detected.

Though the burn-in characteristics of two OLED elements are simultaneously detected on the same detection switch control line TSC in the above description, the burn-in characteristics of three or more OLED elements may be simultaneously detected on the same detection switch control line TSC depending on the condition.

THIRD EMBODIMENT

Figure 7:
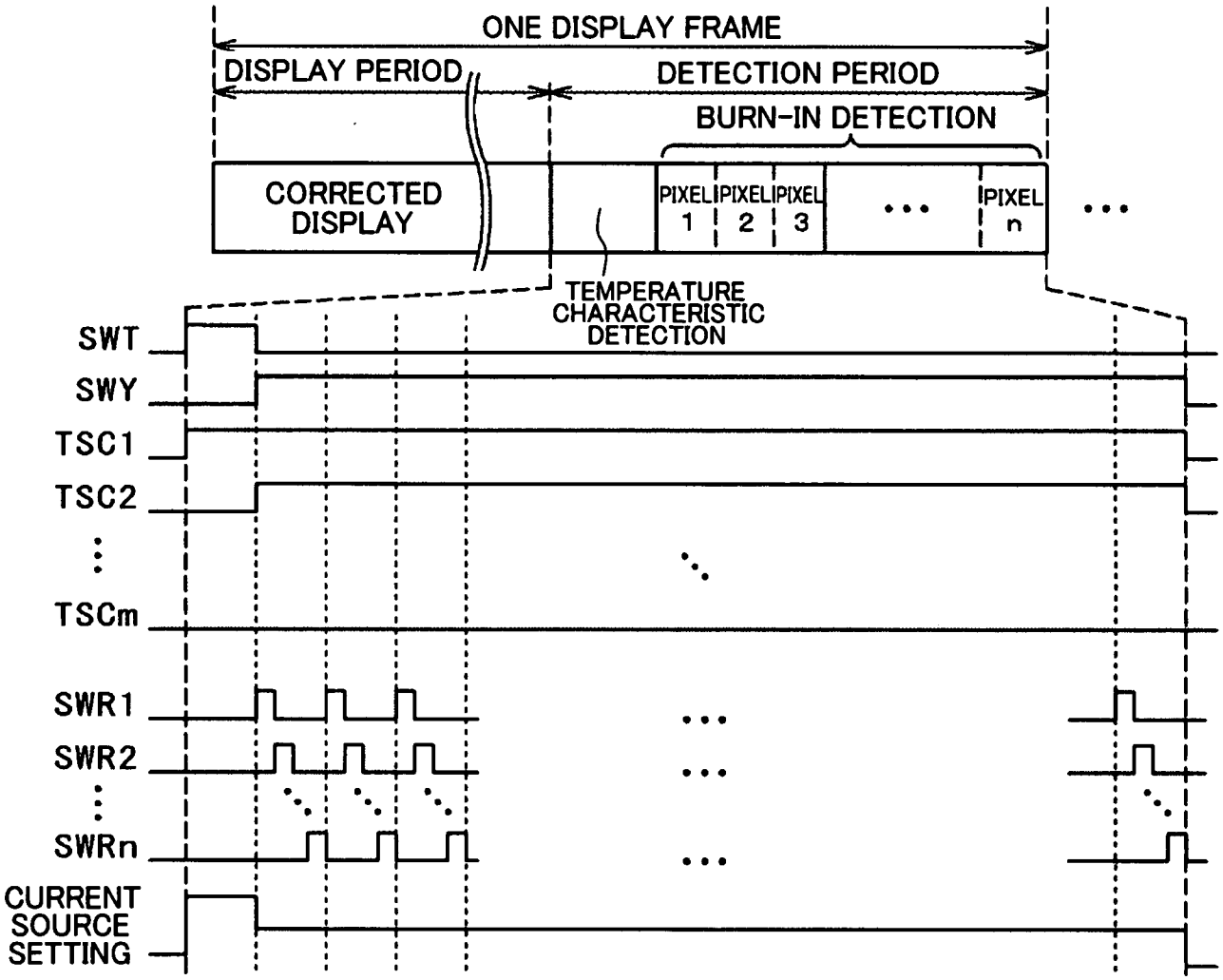
FIG. 7 is a time chart of a third embodiment.

Though a third embodiment is the same as the first embodiment in the configuration of the organic EL display device, the third embodiment differs from the first embodiment in that the current setting of the current source 112 is changed in the detection of the burn-in characteristic. FIG. 7 is a time chart of the burn-in detection in this embodiment. As in the first embodiment, the temperature detection is first performed after the termination of the display in FIG. 7. After the temperature detection, it is determined that the burn-in characteristics of the pixels on the first detection switch control line TSC1 and the second detection switch control line TSC2 are simultaneously detected. In FIG. 7, the third detection switch control line TSC3 and the subsequent detection switch control lines are in an OFF state.

In this embodiment, it is determined that the current value of the current source 112 for the detection of the burn-in characteristics is lowered after the detection of the temperatures of the OLED elements. The current value of the current source 112 is determined to be lowered because the result of the temperature detection shows that the resistance of each of the OLED elements is increased. As an example of the case where the resistance of the OLED element is increased, a low ambient temperature is given. In this case, the current value of the current source 112 is lowered to set the fluctuation in terminal voltage of the OLED element in the burn-in detection to fall within the input range of the analog-to-digital converter ADC.

Though the current value of the current source 112 is lowered as a result of the increase in resistance of the OLED element in the burn-in detection when the temperature becomes low in this embodiment, the number of the OLED elements to be simultaneously measured in the burn-in detection may be increased instead. Though a detection speed is increased in this case, a resolution of the detection is lowered. Therefore, whether or not to lower the current value of the current source 112 may be determined in view of the speed and resolution of the detection.

FOURTH EMBODIMENT

Figure 8:
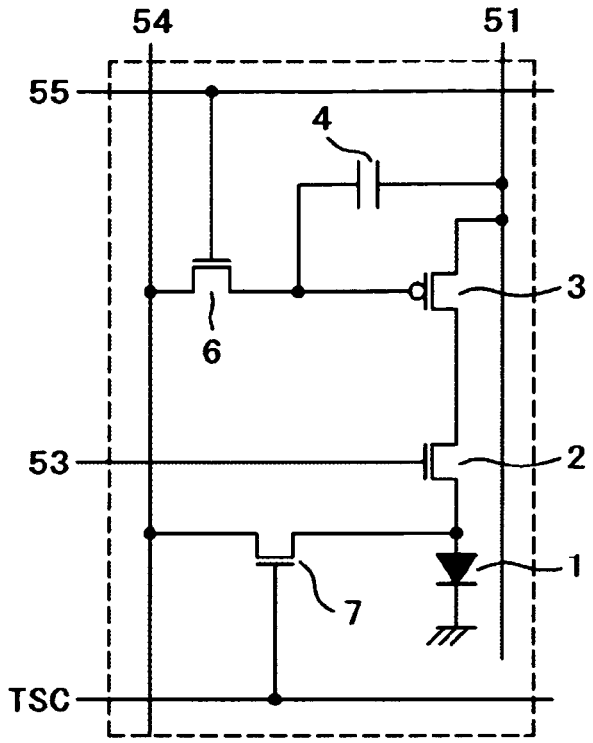
FIG. 8 is a view illustrating a pixel circuit according to a fourth embodiment.

FIG. 8 illustrates an example of a circuit configuration of the pixel which is subjected to the temperature detection and the burn-in detection described above. FIG. 8 illustrates the most common pixel structure. In FIG. 8, an OLED driving TFT 3, a lighting TFT switch 2 and an OLED element 1 are connected in series from a power wire 51. In FIG. 8, an operation for displaying an image is first described. In FIG. 8, when a select control line 55 extending from the scanning circuit for display 200 becomes ON, a select switch 6 also becomes ON to select the corresponding pixel. When the select switch 6 becomes ON, electric charges according to the image signal from a signal line 54 are accumulated in a holding capacitor 4. Thereafter, the select control line 55 is turned OFF to open the select switch 6. A lighting switch line 53 is turned ON to close the lighting TFT switch 2. As a result, the current from the power wire 51 flows through the OLED driving TFT 3 according to a gate potential according to the charges accumulated in the holding capacitor 4, thereby causing the OLED element to emit light.

When the display for one frame is completed, the temperature detection and the burn-in detection of the OLED element 1 are performed. When the temperature detection and the burn-in detection are performed in the case illustrated in FIG. 8, the detection switch control line TSC is turned ON to close a detection switch 7. At this time, the switch SWS illustrated in FIG. 1 is opened to supply not the signal from the signal driving circuit 100 but the detection current from the current source 112 of the detection section 300 to the signal line 54. When the detection switch 7 is closed, the detection current flows through the OLED element 1. The terminal voltage of the OLED element 1 is measured in the detection section 300 illustrated in FIG. 1.

When the temperature detection or the burn-in detection of the OLED element 1 illustrated in FIG. 8 is completed, the detection switch control line TSC becomes OFF to open the detection switch 7. As described in the first embodiment, the data of the temperature detection is used for setting the condition for the burn-in detection and the data of the burn-in detection is fed back to the image signal. Though the temperature detection and the burn-in detection are performed in the same manner, there is a low probability of simultaneously performing the temperature detection and the burn-in detection for general pixels because the temperature detection is performed only once for one frame.

FIFTH EMBODIMENT

Figure 9:
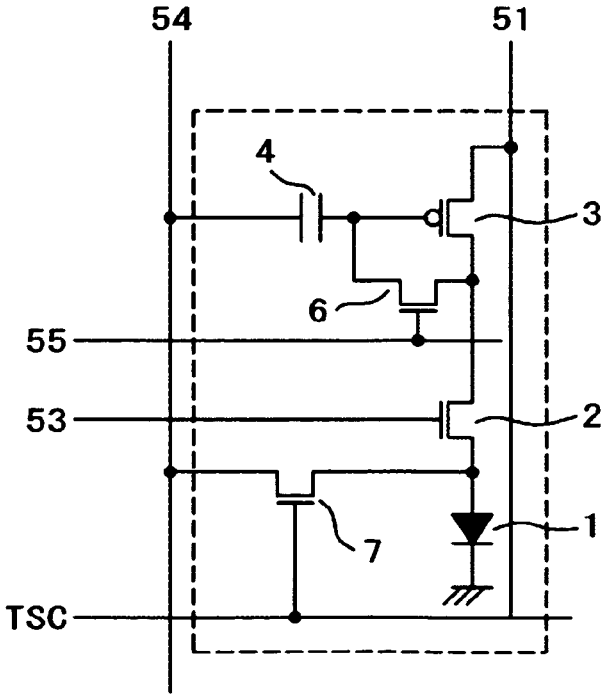
FIG. 9 is a view illustrating the pixel circuit according to a fifth embodiment.

FIG. 9 illustrates another example of the circuit configuration of the pixel which is subjected to the temperature detection and the burn-in detection, which have been described in the first to third embodiments. FIG. 9 illustrates a configuration obtained by adding the detection switch 7 and the detection switch control line TSC to a pixel circuit with an emission period modulation method corresponding to one of voltage programming methods. In the emission period modulation method, one frame is divided into a write period and an emission period. In the write period, the electric charges according to the image signal are accumulated in the holding capacitor 4. In the emission period, the emission period of the OLED element 1 is controlled according to the charges accumulated in the holding capacitor 4 to form the image.

The pixel illustrated in FIG. 9 is driven in the following manner. In FIG. 9, the OLED driving TFT 3, the lighting TFT switch 2, and the OLED element 1 are connected in series from the power wire 51. As described above, the display period is divided into the write period and the emission period. When the select control line 55 is turned ON in the write period, the corresponding pixel is selected to start the writing to the holding capacitor 4. Thereafter, the lighting TFT switch 2 is turned ON for a short period of time to allow the current to flow through the OLED element 1 for a short period of time. As a result, the gate potential of the OLED driving TFT 3 is set to a voltage obtained by subtracting a threshold voltage Vth of the OLED driving TFT 3 from the power supply voltage. As a result, the electric charges accumulated in the holding capacitor 4 have a value obtained by canceling a variation in the threshold voltage Vth of the OLED driving TFT 3 to enable accurate gradation display. When the writing to the pixel is terminated, the emission period starts to feed a triangular wave to the signal line 54. As a result, an operation time of the OLED driving TFT 3 is determined according to the electric charges accumulated in the holding capacitor 4. Then, the current flows through the OLED element q to form the image.

When the display period is terminated in the manner as described above, the temperature detection and the burn-in detection of the OLED element 1 are performed. For the detection of the characteristics of the OLED element 1, the current from the constant current source 112 of the detection section 300 illustrated in FIG. 1 is supplied to the signal line 54. When the detection switch control line TSC illustrated in FIG. 9 is turned ON to close the detection switch 7 in this state, the current flows through the OLED element 1. Then, the detection section 300 illustrated in FIG. 1 measures the terminal voltage of the OLED element 1. The subsequent operation is the same as that described in the fourth embodiment. Even in the pixel circuit according to the fifth embodiment, both the temperature detection and the burn-in detection of the OLED element 1 may be performed by providing the detection switch 7 and the detection switch control line TSC.

SIXTH EMBODIMENT

Figure 10:
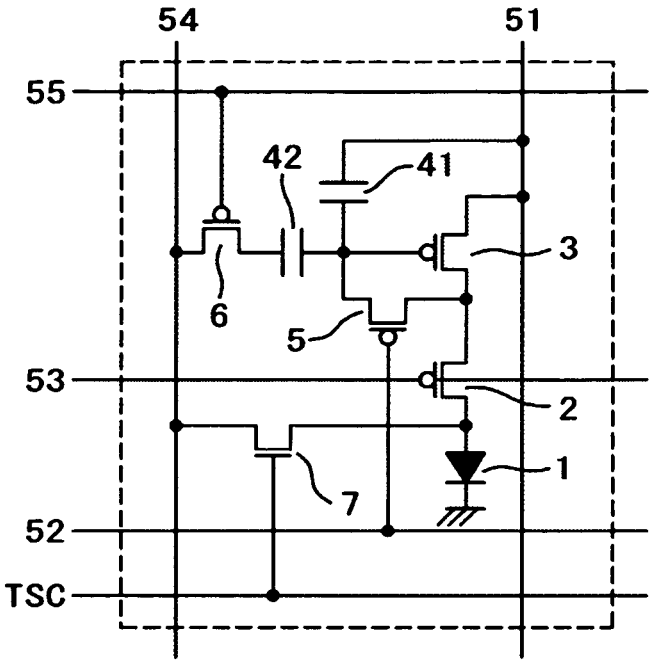
FIG. 10 is a view illustrating the pixel circuit according to a sixth embodiment.

FIG. 10 illustrates still another example of the circuit configuration of the pixel which is subjected to the temperature detection and the burn-in detection, which have been described in the first to third embodiments. FIG. 10 illustrates a configuration obtained by adding the detection switch 7 and the detection switch control line TSC to the most common circuit for reducing a variation between the TFTs with the voltage programming method. The pixel circuit illustrated in FIG. 10 is driven in the following manner. In FIG. 10, the OLED driving TFT 3, the lighting TFT switch 2, and the OLED element 1 are connected in series from the power wire 51. The lighting TFT switch 2 controls whether or not to allow the OLED element 1 to emit light. When the select line 55 is turned ON, the select switch 6 is closed. Then, the image signal is fed from the signal line 54. The electric charges according to the image signal are accumulated in holding capacitors 41 and 42 which are connected in series. In FIG. 10, a reset line 52 is turned ON to turn a reset TFT switch 5 and a lighting switch control line 530N to simultaneously close the lighting TFT switch 2 and the reset TFT switch 5 for a short period of time. As a result, the gate potential of the OLED driving TFT 3 may be set to a potential obtained by canceling the variation in the threshold voltage Vth of the OLED driving TFT 3 to enable the accurate gradation display. After image data is written in the above-mentioned manner in the pixel circuit illustrated in FIG. 10, the reset TFT switch 5 and the select switch 6 are opened to turn the lighting TFT switch 2 ON to allow the OLED element 1 to emit light. As a result, the image is formed.

When the display period, in which the pixel circuit operates in the above-mentioned manner, is terminated, the temperature detection and the burn-in detection of the OLED element 1 are performed. For the detection of the characteristics of the OLED element 1, the current from the constant current source 112 of the detection section 300 illustrated in FIG. 1 is supplied to the signal line 54. When the detection switch control line TSC illustrated in FIG. 10 is turned ON to close the detection switch 7 in this state, the current flows through the OLED element 1. Then, the terminal voltage of the OLED element 1 is measured in the detection section 300 illustrated in FIG. 1. The subsequent operation is the same as that described in the fourth embodiment. Even in the pixel circuit according to this embodiment, both the temperature detection and the burn-in detection of the OLED element 1 may be performed by providing the detection switch 7 and the detection switch control line TSC.

Though the examples in which the present invention is applied to three types of pixel circuits have been described in the fourth to sixth embodiments, the application of the present invention is not limited to the circuit configurations of the fourth to sixth embodiments. The present invention may be carried out for the pixels having other circuit configurations by using the detection switch control line TSC, the detection switch 7, or the equivalents thereof as described in the fourth to sixth embodiments.

Figure 17B:
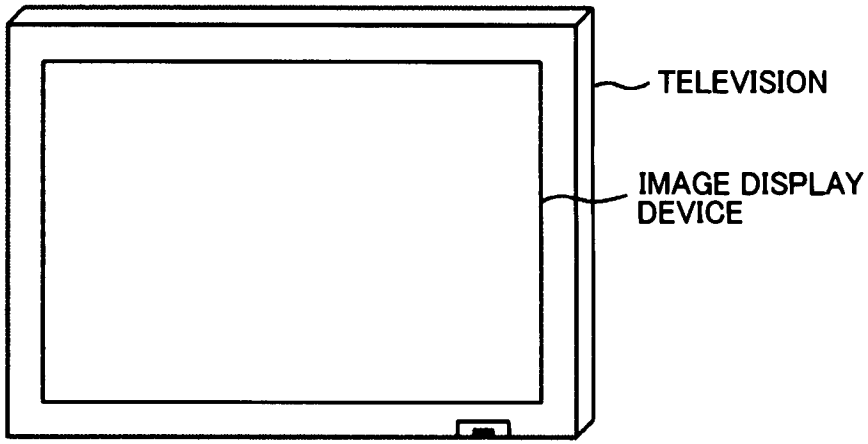
FIGS. 17A and 17B are views, each illustrating an example of a product to which the organic EL display device according to the present invention is applied.
Figure 17A:
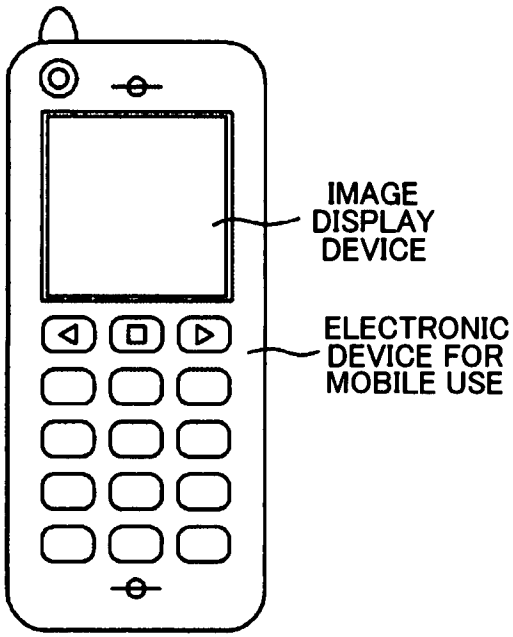

Each of FIGS. 17A and 17B illustrates an example of a product, to which the organic EL display device according to the present invention is applied. FIG. 17A illustrates an example in which the organic EL display device according to the present invention is applied to a cellular phone. The cellular phone is used in a wide temperature range, and hence the organic EL display device having both the function of detecting the temperature characteristic and the correction function, to which the present invention is applied, is suitable for the cellular phone. FIG. 17B illustrates an example in which the organic EL display device according to the present invention is applied to a television. The television is used for a long period of time, and hence the television is likely to be affected by the burn-in of the OLED elements 1. The burn-in may be effectively corrected in the present invention, and hence the organic EL display device is suitable for the television.

Figure 18B:
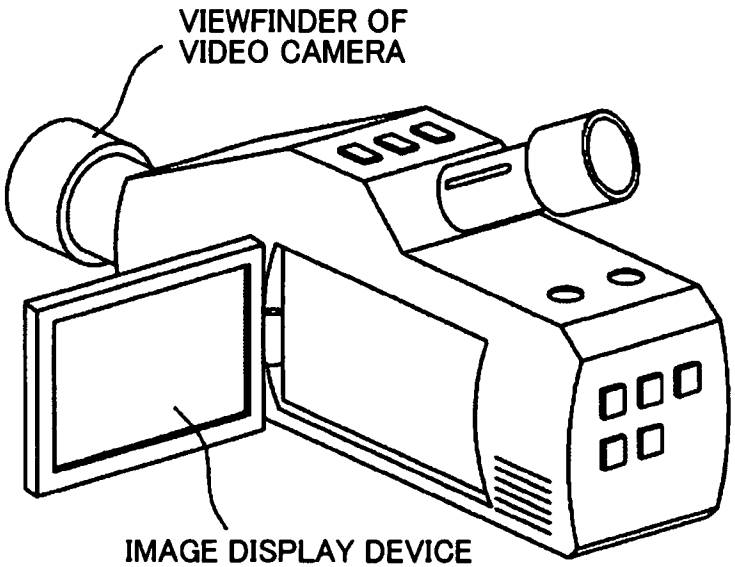
FIGS. 18A and 18B are views, each illustrating a further example of the product to which the organic EL display device according to the present invention is applied.
Figure 18A:
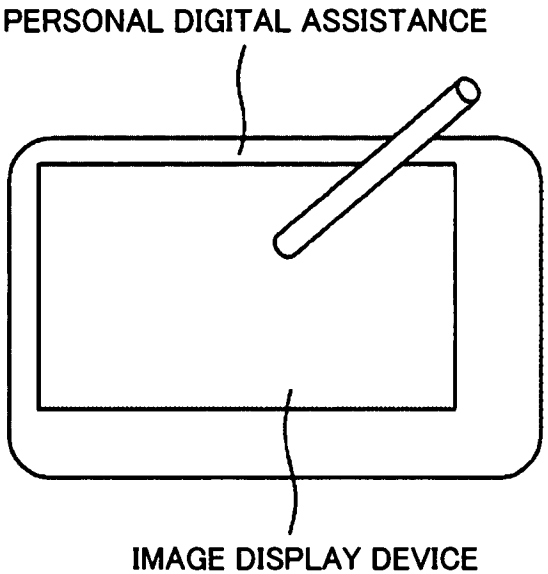

Each of FIGS. 18A and 18B illustrates another example of the product to which the organic EL display device according to the present invention is applied. FIG. 18A illustrates an example in which the organic EL display device according to the present invention is applied to a personal digital assistant PDA, whereas FIG. 18B illustrates an example in which the organic EL display device according to the present invention is applied to a viewfinder of a video camera CAM. Both the PDA and the video camera are used outdoor and are susceptible to a wide change in environmental temperature, and hence the organic EL display device which effectively compensates for the change in temperature and the burn-in of the OLED element 1 as in the present invention is suitable for the products described above.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An organic electroluminescence display device, comprising:

a display section including a plurality of pixels arranged in a matrix; and a detection section for detecting, for each of the pixels, a temperature characteristic value of an OLED element in the pixel and a burn-in characteristic value of the OLED element in the pixel, wherein the detection section includes first and second paths for the burn-in characteristic value and the temperature characteristic value respectively, the first path for allowing the burn-in characteristic value of the OLED element in each of the pixels to pass therethrough, the second path for attenuating the temperature characteristic value of the OLED element in each of the pixels and allowing the attenuated temperature characteristic value to pass therethrough, a first switch is provided for the first path whereas a second switch is provided for the second path, the second switch being opened when the first switch is closed, each of the temperature characteristic value and the burn-in characteristic value detected for the OLED element in the same pixel is, upon passing through the second path for the temperature characteristic value detected for the OLED element or passing through the first path for the burn-in characteristic value detected for the OLED element, input to a same analog-to-digital converter to be converted into a digital quantity, and the second path limits a range of the temperature characteristic value to within a range of the analog-to-digital converter.

2. An organic electroluminescence display device according to claim 1, wherein the temperature characteristic value is a voltage value at a terminal of the OLED element, the voltage value being generated by supplying a current from a current source provided in the detection section to the OLED element.

3. An organic electroluminescence display device according to claim 1, wherein the second path includes a first resistor, and the attenuation of the temperature characteristic value is defined outside the second path by a ratio between a second resistor connected to the first resistor in series and the first resistor.

4. An organic electroluminescence display device according to claim 1, wherein a buffer amplifier is provided between the analog-to-digital converter and any one of the first path and the second path.

5. An organic electroluminescence display device according to claim 1, wherein each of the temperature characteristic value and the burn-in characteristic value is a voltage value at a terminal of the OLED element, the voltage value being generated by supplying a current from a current source provided in the detection section to the OLED element.

6. An organic electroluminescence display device according to claim 1, wherein the temperature characteristic value is detected prior to the detection of the burn-in characteristic value, and a condition for the detection of the burn-in characteristic is determined by the temperature characteristic value digitalized by the analog-to-digital converter.

7. An organic electroluminescence display device according to claim 6, wherein the burn-in characteristic is measured for a plurality of the pixels in a row direction in the pixels arranged in the matrix.

8. An organic electroluminescence display device according to claim 6, wherein the burn-in characteristic is measured for a plurality of the pixels in a column direction in the pixels arranged in the matrix.

9. An organic electroluminescence display device according to claim 1, wherein each of the temperature characteristic value and the burn-in characteristic value is a voltage value at a terminal of the OLED element, the voltage value being generated by supplying a current from a constant current source provided in the detection section to the OLED element, and a current value supplied from the constant current source for detecting the burn-in characteristic differs from that supplied from the constant current source for detecting the temperature characteristic.

10. An organic electroluminescence display device comprising:

a display section including a plurality of pixels arranged in a matrix; and a detection section for detecting, in each of the pixels, a temperature characteristic value of an OLED element in the pixel and a burn-in characteristic value of the OLED element in the pixel, wherein each of the temperature characteristic value and the burn-in characteristic value for each pixel is a voltage value at a terminal of the OLED element in the pixel, the voltage value of each value for each pixel being generated by supplying a current from a current source provided in the detection section to the OLED element, a detection switch for controlling a flow of the current from the current source to the OLED element in each pixel is provided in the pixel, the detection switch for each pixel being connected to the OLED element in the pixel;

the detection section includes first and second paths for the burn-in characteristic value and the temperature characteristic value respectively, the first path for allowing the burn-in characteristic value of the OLED element in each of the pixels to pass therethrough, the second path for attenuating the temperature characteristic value of the OLED element in each of the pixels and allowing the attenuated temperature characteristic value to pass therethrough, a first switch is provided for the first path whereas a second switch is provided for the second path, the second switch being opened when the first switch is closed, each of the temperature characteristic value and the burn-in characteristic value detected for the OLED element in the same pixel is, upon passing through the second path for the temperature characteristic value detected for the OLED element or passing through the first path for the burn-in characteristic value detected for the OLED element, input to a same analog-to-digital converter to be converted into a digital quantity, and the second path limits a range of the temperature characteristic value to within a range of the analog-to-digital converter.

* * * * *